US007513232B2

(12) United States Patent
Schneider

(10) Patent No.: US 7,513,232 B2
(45) Date of Patent: Apr. 7, 2009

(54) ADJUSTABLE CAMSHAFT, IN PARTICULAR FOR INTERNAL COMBUSTION ENGINES FOR MOTOR VEHICLES HAVING A HYDRAULIC ADJUSTING DEVICE

(75) Inventor: Falk Schneider, Korntal-Münchingen (DE)

(73) Assignee: Mahle International GmbH, Stuttgart (DE)

( * ) Notice: Subject to any disclaimer, the term of this patent is extended or adjusted under 35 U.S.C. 154(b) by 140 days.

(21) Appl. No.: 11/629,436

(22) PCT Filed: Jan. 13, 2006

(86) PCT No.: PCT/DE2006/000039

§ 371 (c)(1),
(2), (4) Date: Dec. 13, 2006

(87) PCT Pub. No.: WO2006/081789

PCT Pub. Date: Aug. 10, 2006

(65) Prior Publication Data

US 2007/0240657 A1 Oct. 18, 2007

(30) Foreign Application Priority Data

Feb. 3, 2005 (DE) ..... 10 2005 005 212
Aug. 30, 2005 (DE) ..... 10 2005 040 934

(51) Int. Cl.
*F01L 1/34* (2006.01)

(52) U.S. Cl. ..... 123/90.17; 123/90.15; 123/90.6; 464/160

(58) Field of Classification Search ..... 123/90.15, 123/90.16, 90.17, 90.18, 90.27, 90.31; 464/1, 464/2, 160

See application file for complete search history.

(56) References Cited

U.S. PATENT DOCUMENTS

| | | | | |
|---|---|---|---|---|
| 5,794,578 | A | 8/1998 | Strauss et al. | |
| 5,829,399 | A | 11/1998 | Scheidt et al. | |
| 6,363,897 | B2 | 4/2002 | Scheidt et al. | |
| 6,481,401 | B1 | 11/2002 | Schäfer | |
| 7,069,892 | B2 * | 7/2006 | Lechner et al. | 123/90.6 |

FOREIGN PATENT DOCUMENTS

| | | |
|---|---|---|
| DE | 195 25 837 A1 | 1/1997 |
| DE | 19615076 | 6/1997 |
| DE | 19645688 | 5/1998 |
| DE | 19820063 | 11/1999 |
| DE | 69512962 | 5/2000 |
| DE | 19962981 | 7/2001 |

(Continued)

*Primary Examiner*—Ching Chang
(74) *Attorney, Agent, or Firm*—Collard & Roe, P.C.

(57) ABSTRACT

An adjustable camshaft has at least one adjusting element of an adjusting system fixedly connected to inner and outer shafts that is at least partially in tight contact at the end with a connection surface which is formed by a mounting ring of the outer shaft with respect to the two shafts including the mounting ring. The connection surface is crossed by axial passages between hydraulic chambers of the adjusting system and by hydraulic liquid supply ducts which extend through the shafts, between the shafts and/or through annular gaps formed between the outer shaft and the mounting ring, from the connection surface to filling zones which are located in the peripheral surface of the mounting ring and open into circumferential ring-shaped channels associated each with a filling zone of a supply duct.

4 Claims, 6 Drawing Sheets

FOREIGN PATENT DOCUMENTS

Figure 1:
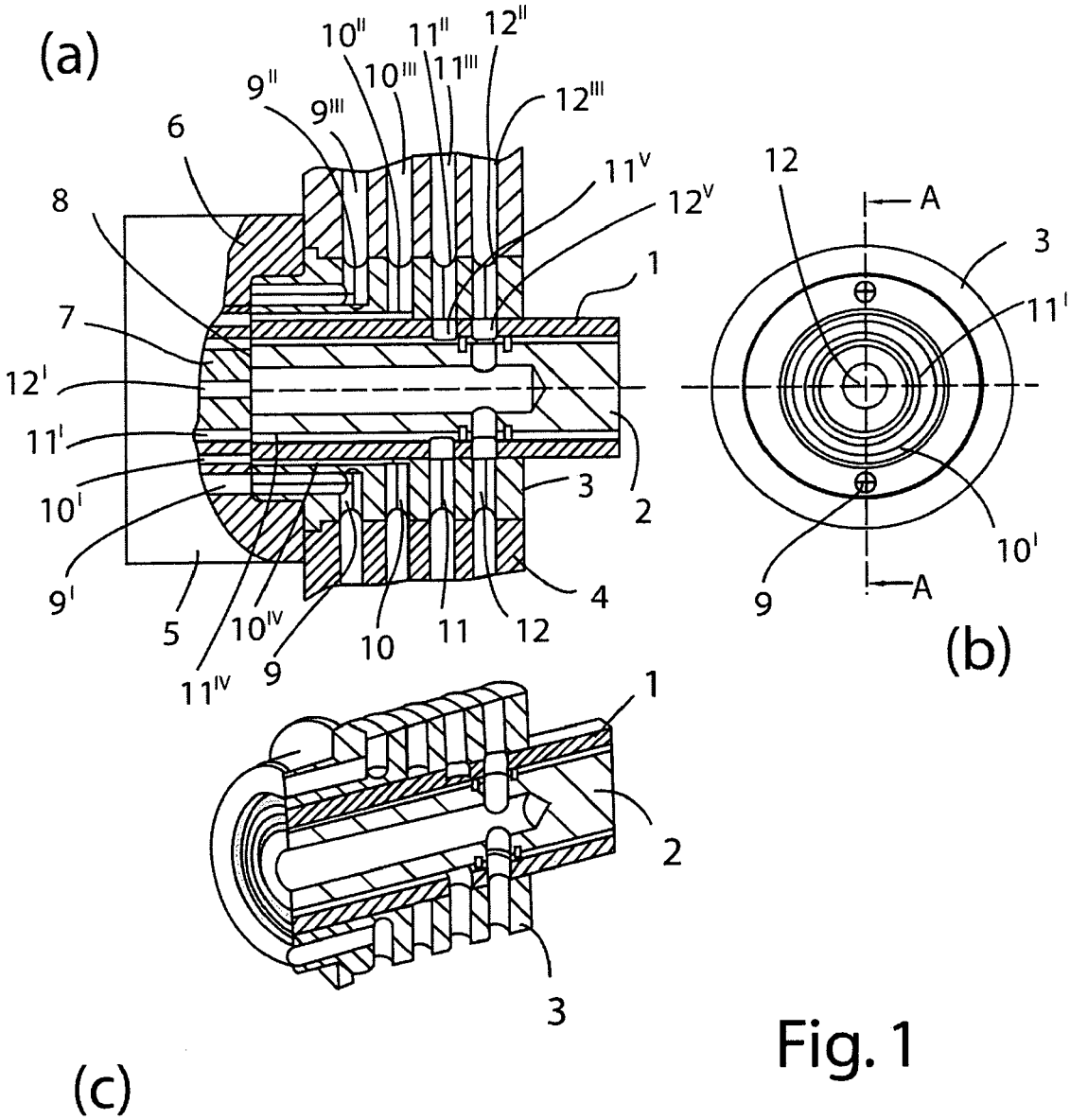

| | | |
|---|---|---|
| DE | 10020119 | 10/2001 |
| EP | 0 686 754 | 12/1995 |
| EP | 1 046 793 | 10/2000 |
| EP | 1 156 191 | 9/2005 |
| JP | 4134106 | 5/1992 |
| JP | 7119418 | 5/1995 |
| JP | 7286507 | 10/1995 |

* cited by examiner

ADJUSTABLE CAMSHAFT, IN PARTICULAR FOR INTERNAL COMBUSTION ENGINES FOR MOTOR VEHICLES HAVING A HYDRAULIC ADJUSTING DEVICE

CROSS REFERENCE TO RELATED APPLICATIONS

Applicant claims priority under 35 U.S.C. §119 of German Application No. 10 2005 005 212.6 filed Feb. 3, 2005 and German Application No. 10 2005 040 934.2 filed Aug. 30, 2005. Applicant also claims priority under 35 U.S.C. §365 of PCT/DE2006/000039 filed Jan. 13, 2006. The international application under PCT article 21(2) was not published in English.

The invention relates to an adjustable camshaft, in particular for internal combustion engines for motor vehicles, having a hydraulic adjusting device according to the preamble of Patent claim 1.

Such camshafts with hydraulic adjusting devices are known in a plurality of embodiments with regard to the supply of hydraulic fluid. For example, the only prior art documents mentioned here are JP 07286507 A, DE 198 20 063 A1, DE 199 62 981 A1, DE 196 45 688 A1, DE 196 15 076 A1, DE 195 25 837 A1, DE 100 20 119 A1, DE 695 12 962 T2.

With such a generic camshaft, and in particular with respect to an embodiment according to JP 07286507 A cited above, a supply of the hydraulic fluid needed for operation of the hydraulic adjusting device should require the smallest possible amount of space in a design that is simple and easy to manufacture.

With such a camshaft, a supply of the hydraulic fluid needed for operation of the hydraulic adjusting device should require the smallest possible amount of space.

This problem is solved with a generic camshaft by an embodiment according to the characterizing features of Patent Claim 1.

An advantageous and expedient embodiment is the subject matter of Claim 2.

The other subclaims pertain to advantageous embodiments of a bearing ring that can be used in particular with an adjustable camshaft according to this invention with circumferential ring channels designed to save on space for carrying hydraulic fluid to be carried through this bearing ring, namely in particular a lubricant oil under pressure.

Thus, with respect to camshafts for internal combustion engines in motor vehicles in particular, this invention is based on the general idea of using the pressurized oil lubrication which is necessary for the bearing ring, including the means serving to accomplish this, at the same time for supplying lubricating oil as hydraulic fluid to the adjusting device.

Advantageous exemplary embodiments that are explained in greater detail below are illustrated in the drawing.

Figure 2:
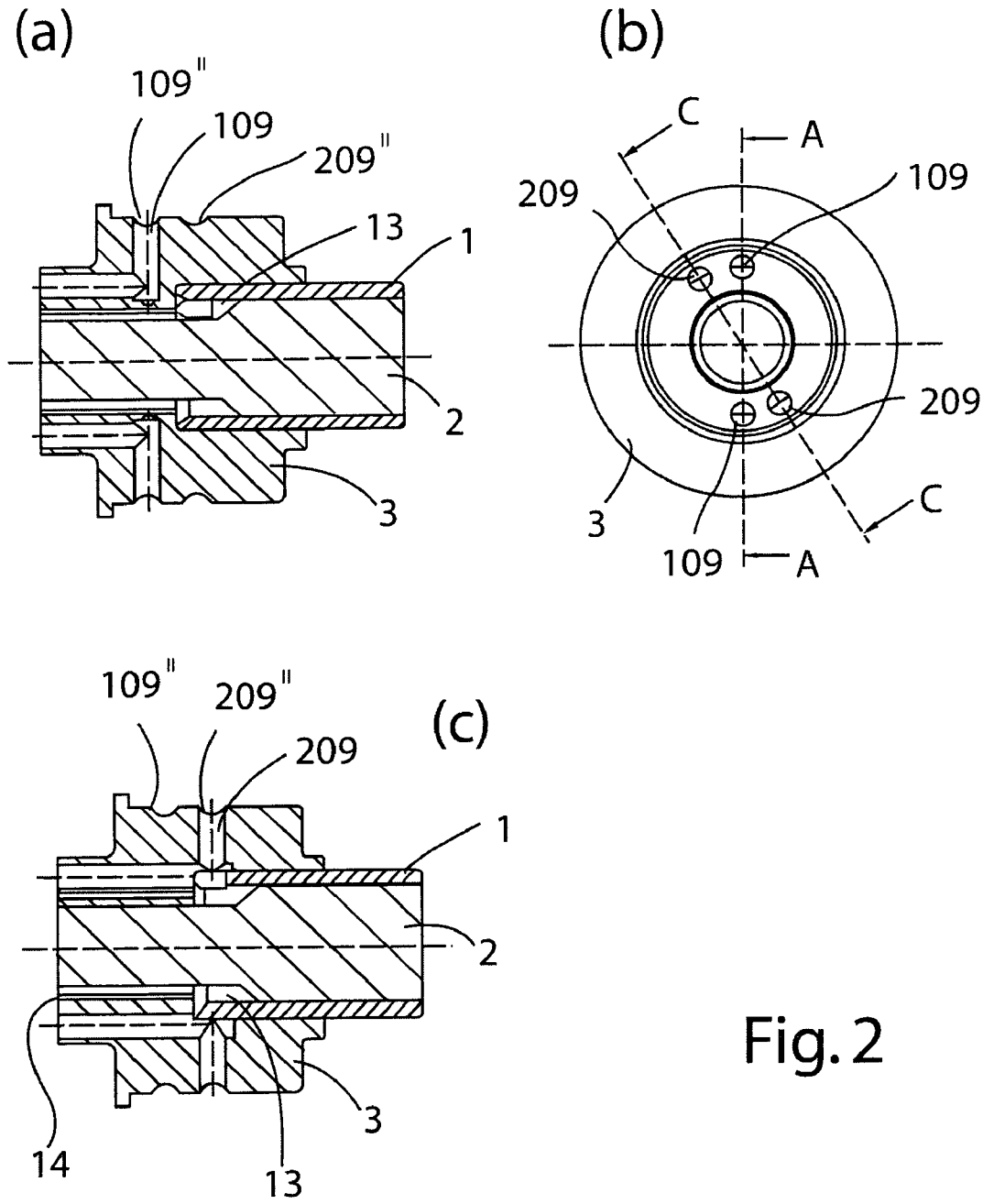
Figure 3:
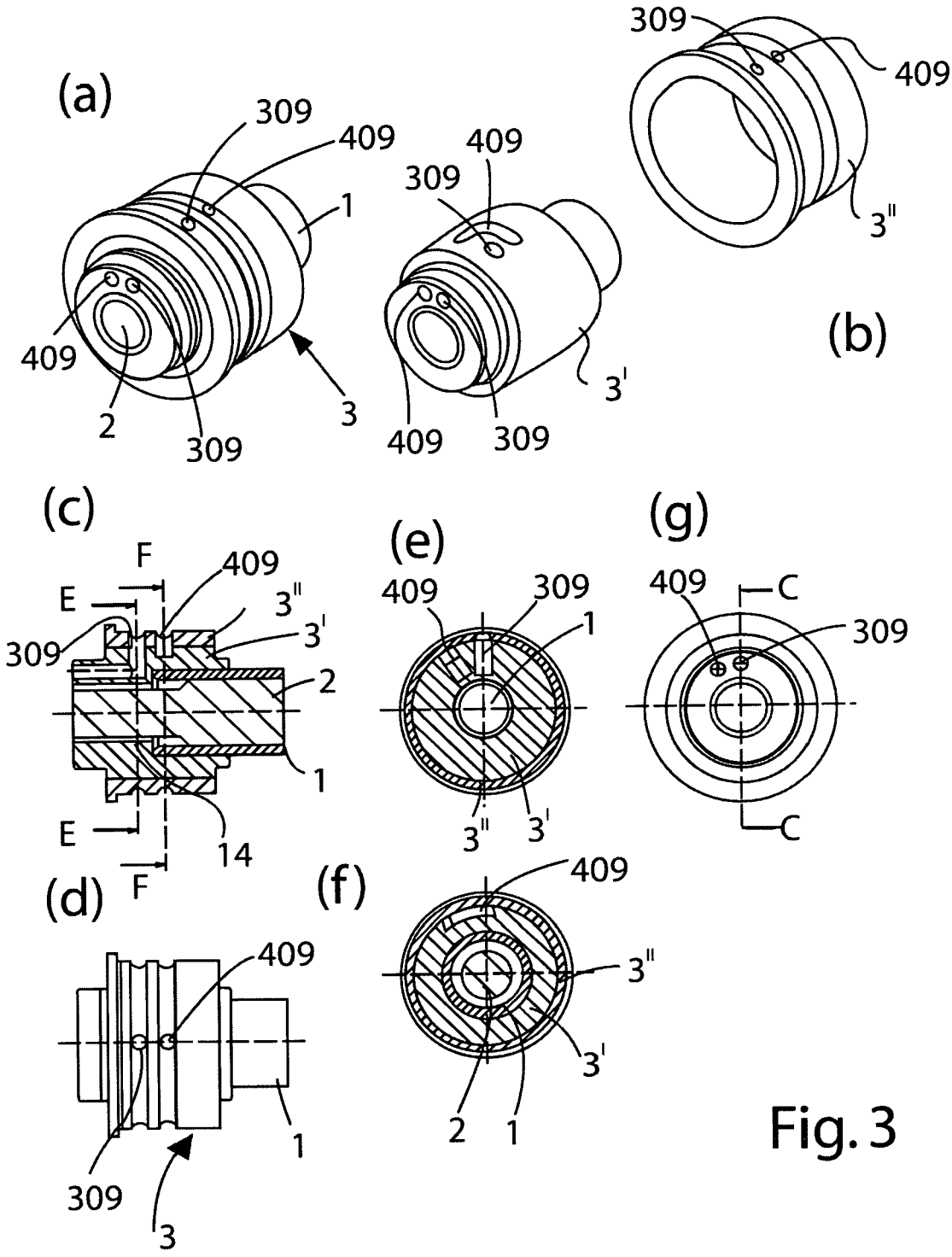
Figure 4:
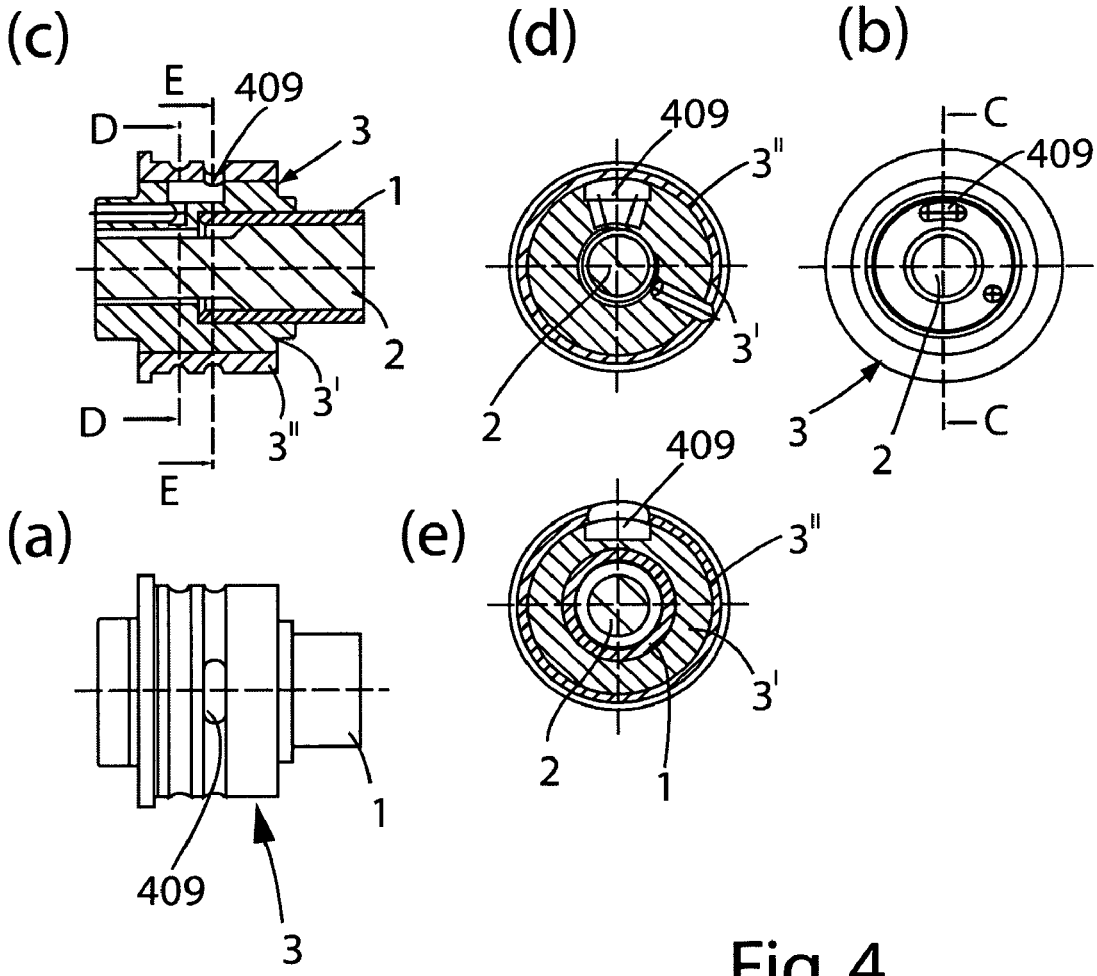
Figure 5:
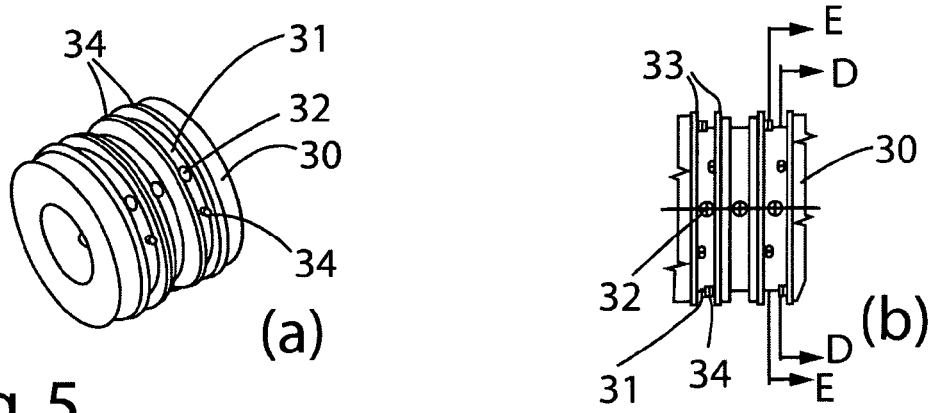
Figure 6:
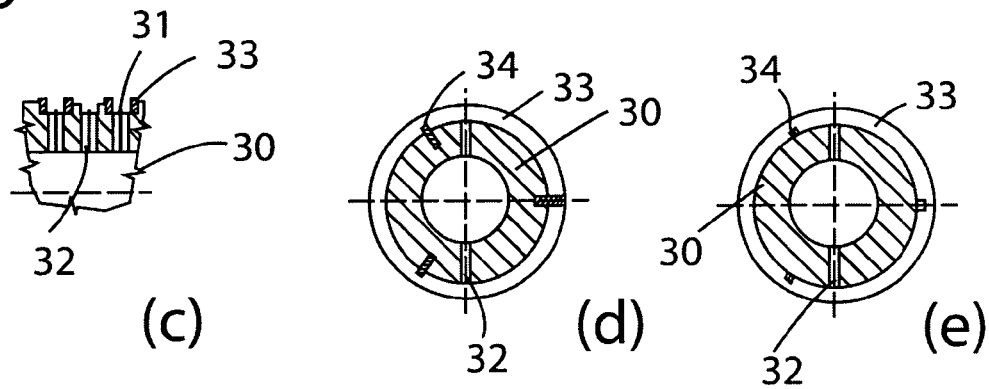
Figure 6:
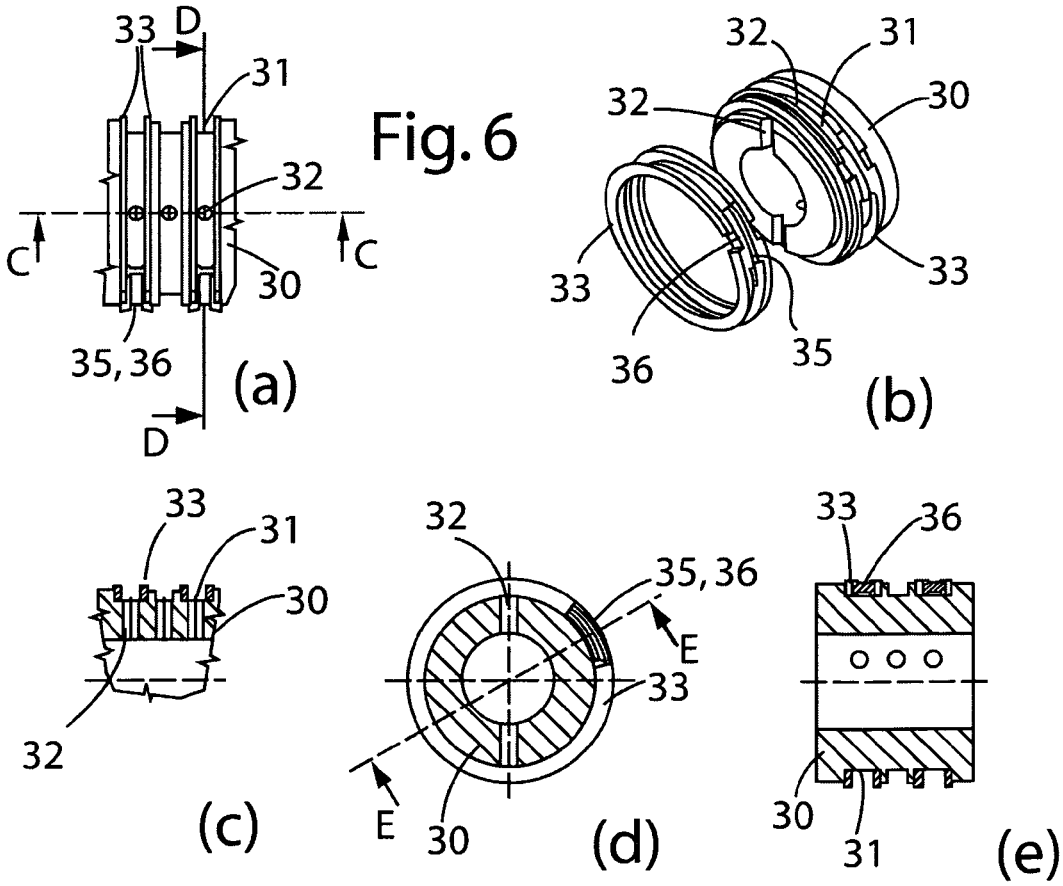
Figure 7:
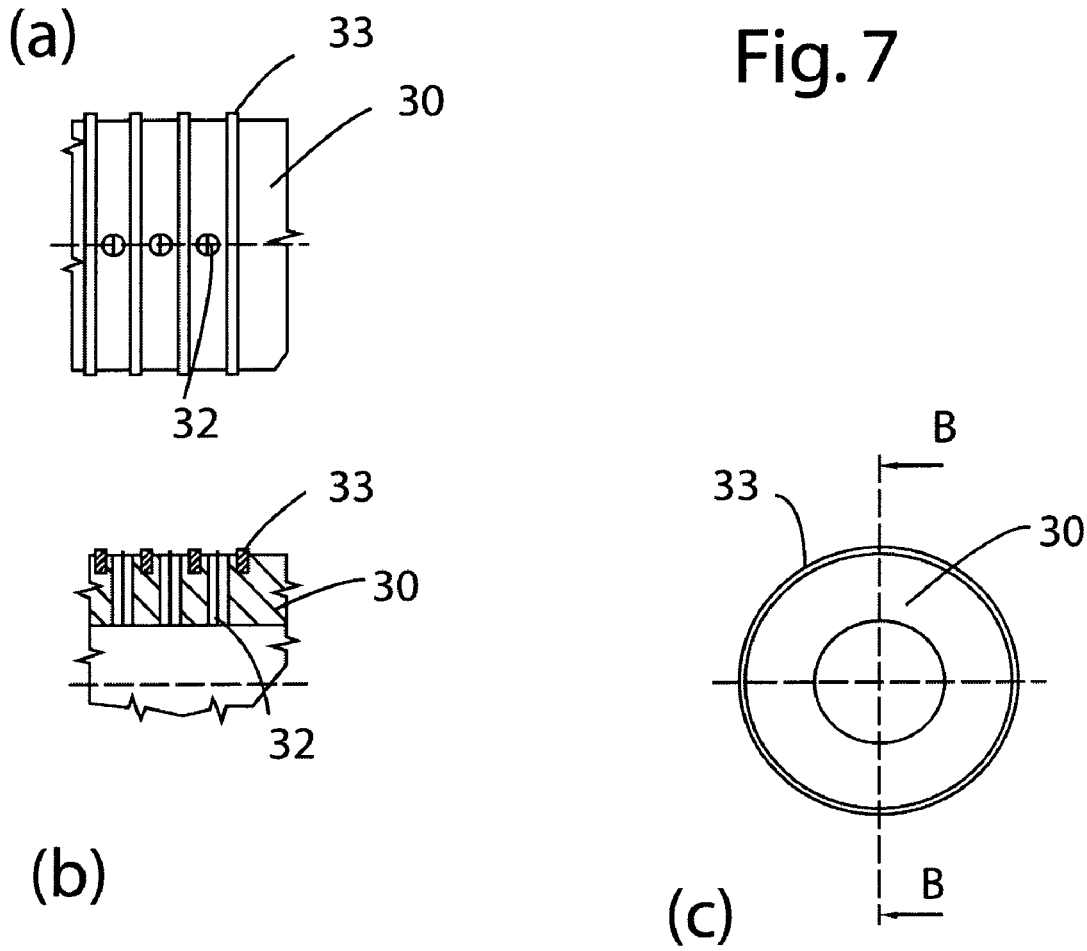

The drawing shows:

FIG. 1 a first variant of an embodiment of a hydraulic fluid supply of a camshaft adjusting device in a) a longitudinal section through an end area of an adjustable camshaft according to sectional line A-A in figure section b, b) a view of the end of the camshaft according to the diagram in a), c) a perspective view of the end of the camshaft shown in part a);

FIG. 2 an alternative embodiment of a hydraulic fluid supply according to FIG. 1 with a smaller number of supply channels and a different design of the end areas of the inner shaft and the outer shaft with the following types of diagrams:

a) a longitudinal section through an end area of the camshaft according to line A-A in figure section b, b) a top view of the end area of the camshaft according to figure section a, c) a longitudinal section through an end area of the camshaft according to figure section a along sectional lines C-C in figure section b;

FIG. 3 a variant of the hydraulic fluid supply through a radially divided bearing ring, with a) a perspective view of the end area of a camshaft having this bearing ring, b) an exploded diagram of the camshaft end area according to figure section a with a diagram of the bearing ring in which an attachable outer ring of the bearing ring is shown separately, c) a longitudinal section along sectional line C-C through the camshaft end section according to figure section a, d) a view from the outside radially of the camshaft end section according to figure section c, e) a section along line E-E through the camshaft end section according to figure section c, f) a section according to line F-F through the camshaft end section in figure section c, g) a view of the camshaft section according to figure section c;

FIG. 4 a variation on the hydraulic fluid feed channels in a bearing ring in a camshaft end area according to the embodiment in FIG. 3, with a) a view of the end section from the outside radially, b) a view of the end of the camshaft end area according to figure section a, c) a longitudinal section through the camshaft end section according to sectional line C-C in figure section b, d) a section through the camshaft end section according to line D-D in figure section c, e) a longitudinal section through the shaft end section according to line E-E in figure section c;

FIG. 5 a bearing ring with circumferential ring channels in various views an sections, namely a) a perspective view, b) in a view from the outside radially, c) in a longitudinal section, d) in a section according to line D-D in figure section b, e) in a section through the bearing ring according to line E-E in figure section b;

FIG. 6 an alternative embodiment of the ring channels of the bearing ring according to FIG. 5 in different views again, namely a) a view from the outside radially, b) in an exploded diagram with a section through a ring channel according to line D-D and a separate diagram of a sealing ring arrangement in the uninstalled state, c) in a longitudinal section according to sectional line C-C in figure section a, d) in a section through the bearing ring according to line D-D in figure section a, e) in a longitudinal section through the bearing ring according to line E-E in figure section d;

FIG. 7 another alternative embodiment of the outer ring channels of a bearing ring in various views, namely a) a view from the outside radially, b) a section through the bearing ring according to line B-B in figure section c, c) a top view of the bearing ring in the axial direction of this bearing ring.

EMBODIMENT ACCORDING TO FIG. 1

The drawing shows only an axial end area of an adjustable camshaft. The camshaft in this area consists of an outer shaft 1 and an inner shaft 2 mounted concentrically in the former. A bearing ring 3 over which the camshaft is rotatably mounted in a stationary abutment 4 is pushed onto the outer shaft 1 and permanently joined to the former by a shrink fit, for example.

The exemplary described here, like all the exemplary embodiments to be described below, relates to an adjustable camshaft of an internal combustion engine for a motor vehicle. With these adjustable camshafts, first cams on the outer shaft 1 are fixedly attached to the outer shaft. Second cams are fixedly attached to the inner shaft 2 with a rotatable bearing on the outer shaft 1. The fixed connection between the second cam and the inner shaft 2 is accomplished through recesses in the outer shaft 1. This design of adjustable camshafts is known in general, which is why it need not be discussed in greater detail at this point and there is no corresponding representation in the drawing.

For mutual rotation of outer shaft 1 and inner shaft 2 relative to one another, a hydraulic adjusting device 5 is used, indicated with dash-dot lines only in partial section a of FIG. 1 in the drawing. This adjusting device 5 includes two adjusting elements that are rotatable in relation to one another, namely a first adjusting element 6 and a second adjusting element 7. The first adjusting element 6 is fixedly attached to the bearing ring 3 and the second adjusting element 7 is fixedly attached to the inner shaft 2. The connection is such that with the two adjusting elements 6, 7, contact is achieved with an end face area of the inner shaft 2, the outer shaft 1 and the bearing ring 3 connected to the latter. In this way, connecting faces on the end are provided between the two adjusting elements 6, 7 on the one hand and the outer shaft 1, the inner shaft 2 and the bearing ring 3 on the other hand, these connecting faces being defined jointly as connecting face 8.

To supply the hydraulic adjusting device 5, a total of four feed channels 9 through 12 are provided in the exemplary embodiment illustrated here. The areas of these feed channels 9 through 12 that are situated outside of the adjusting device 5 are each provided without a primed index, while the partial areas that are inside the adjusting device are each provided with a primed index. The number of feed channels 9 through 12 depends on the design and function to be implemented by the adjusting device 5. Four feed channels 9 through 12 are required in particular with the known embodiments of adjusting devices 5 if the two shafts 1, 2 as a whole are to be adjustable in rotational angle with respect to a stationary bearing, in addition to a relative movement between the inner shaft 2 and the outer shaft 1.

The following comments can be made regarding the arrangement and layout of the individual feed channels 9 through 12.

The feed channel 9 runs only in the bearing ring 3 outside of the adjusting device 5, where it communicates with a respective feed channel 9' in the first adjusting element 6 of the adjusting device 5 via a connecting face 8 on the end. The feed channel 9 opens at one end into the connecting face 8 in parallel axially with the camshaft and opens at the other end radially into a ring channel 9" in the outside circumferential area of the bearing ring 3. This feed channel is produced by intersecting blind hole bores starting from the connecting face 8 on the one end and the ring channel 9" on the other end. The ring channel 9" is supplied with hydraulic fluid, i.e., lubricating oil under pressure in this case in the exemplary embodiment described here, from an inlet channel 9'" allocated to the abutment 4.

The next feed channel 10, i.e., the one directly adjacent to the feed channel 9, in turn extends between the connecting area 8 and a ring channel 10" on the outside circumferential surface of the bearing ring 3. Lubricating oil is supplied to this feed channel 10 in the same way as with the feed channel 9 described above. The same thing is also true of the feed channels 11 and 12 to be described below. In deviation from the feed channel 9, feed channel 10 is not composed of intersecting blind hole bores inside the bearing ring 3. Instead, the feed channel 10 consists of a radial bore running through the entire radial thickness of the bearing ring 3, and of a radial ring gap $\mathbf{10}^{IV}$ between the outer shaft 1 and the bearing ring 4. A feed channel 10' is allocated to the ring gap $\mathbf{10}^{IV}$ via the connecting area 8 and/or through the latter within the adjusting device 5, in a manner that allows communicating flow. Through the ring gap $\mathbf{10}^{IV}$ the bearing ring 3 sits tightly on the outer shaft 1 exclusively via its area, which is in proximity to this ring gap $\mathbf{10}^{IV}$ axially.

The feed channel 11 is similar to the feed channel 10 described previously with regard to design and layout. This feed channel 11 also opens via a ring channel $\mathbf{11}^{IV}$ into a respective feed channel 11' via the connecting area 8 into the adjusting device 5. A radial bore $\mathbf{11}^{V}$ passing through the outer shaft 1 serves to connect the ring channel $\mathbf{11}^{IV}$ to the area of the feed channel 11 that runs radially.

The feed channel 12, like the feed channel 11, has a radial bore inside the bearing ring 3, opening into intersecting blind hole bores within the inner shaft 2 via a respective radial through-hole $\mathbf{12}^{V}$ of the outer shaft 1. The axial area of these blind hole bores of the feed channel 12 opens via the connecting area 8 into a corresponding feed channel 12' inside the adjusting device 5.

Special advantages of this embodiment comprise the following.

The inner shaft 2 may be provided with a large outside diameter up to its axial end inside the camshaft, so that a good torsional rigidity is achieved. A constantly uniform diameter implementable over the entire length of the inner shaft 2 simplifies manufacturing of the inner shaft. In particular, a plurality of feed channels may be provided, each of which may be controlled individually. The arrangement of the feed channels permits in particular a row of hydraulic fluid supply to the adjusting device 5 in a manner that is free of axial forces.

EMBODIMENT ACCORDING TO FIG. 2

In this embodiment, the design of two feed channels 109 and 209, which are the only ones provided here, is based on the design of the feed channel 9 in the exemplary embodiment illustrated in FIG. 1. The design of the feed channels 9 according to FIG. 1 matches the design of the feed channel 109 according to FIG. 2. The only difference is the embodiment of the second feed channel 209 which is provided in the exemplary embodiment according to FIG. 2.

The difference in the embodiment of the feed channel 209 results exclusively from a different design of the respective end area of the camshaft in which the inner shaft 2 protrudes axially beyond the respective end of the outer shaft 1 on the one hand and on the other hand has stepwise gradations to a section with a smaller diameter.

Due to the predetermined dimension of the bearing ring 3 with the smallest possible design volume, in particular radially, the second feed channel 209, which must be supplied by a ring channel 209" that is axially adjacent to the ring channel 109" must be offset on the circumference with respect to its radial course within the bearing ring 3 in comparison with the respective area of the feed channel 109 due to the design. In addition, the radial area of this feed channel 209 must pass through the outer shaft 1. The radial area of the feed channel 209 may open here into a ring channel 13 which is formed by the end section of the inner shaft 2 which has a reduced diameter. In this embodiment, the ring channel 209 is closed by a connection that is screw into an inside thread 14 of the bearing ring 3 from the adjusting device 5 (not shown here), the inner shaft 2 being rotatably mounted in this connection. By including the ring channel 13 in the course of the feed channel 209, the radial area of this feed channel 209 and its outlet into the connecting area 8 may run differently on the circumference in a simple manner in the sense of the embodiment according to FIG. 1.

EMBODIMENT ACCORDING TO FIG. 3

In contrast with the embodiment according to FIG. 1, here again only two feed channels 309 and 409 are shown and described here. However, this embodiment is also fundamentally suitable for more than two feed channels, i.e., in particular for four feed channels according to the embodiment in FIG. 1.

The difference in comparison with the embodiment according to FIG. 2, in which only two feed channels are likewise shown and described, is merely that in the embodiment according to FIG. 3, a radially divided bearing 3 is used, consisting of an inner ring area 3' and an outer ring 3" which is pushed onto the former. The outer ring 3" may be shrunk onto the inner bearing ring 3', for example, thus creating a tight connection between the two bearing ring parts 3', 3". Due to the division of the bearing ring 3 into an inner area 3' and an outer ring 3", the feed channel 409, which is at a greater distance axially from the end of the camshaft than the feed channel 309 may be deflected within the inner bearing ring area 3' so that the feed channel 409 jointly with the other feed channel 309 can be guided in the radially inner area of the bearing ring outside of the outer shaft 1, i.e., the outer shaft 1 need not be excluded radially. The partial section f of FIG. 3 shows how this can be possible in terms of manufacturing by a simple method, showing the very clearly discernible angular layout of the feed bore 409. Such an angular layout can also be produced extremely easily in a divided bearing ring 3', 3" but not in a one-piece bearing ring 3.

In a divided embodiment of the bearing ring 3, the outer bearing ring 3" and the inner bearing ring 3' may be made of different materials, namely each adapted to the requirements made of these areas. For example, the outer bearing ring 3" may be made of a material that is especially suitable tribologically, whereas the inner bearing ring area 3' may be made of a high-strength material to be able to transfer and accommodate the driving forces. In the case of a divided bearing ring design, the feed channels may be designed to be milled at least in some areas, so that this makes it possible to manufacture feed channels having changes in directions more easily in comparison with feed channels that are simply drilled. In particular, a plurality of small bores may be combined to form a required larger flow section if a bore of a larger diameter cannot be implemented in terms of the available design space. The bearing ring 3 may be machined completely before assembly on a camshaft, i.e., the outer shaft 1, which has a positive effect on the manufacturing time, the cost and quality.

EMBODIMENT ACCORDING TO FIG. 4

The embodiment shown here illustrates how milled oil feed cross sections can be implemented in a radially divided bearing ring 3, namely on the example of the feed channel 409 in FIG. 3.

BEARING RING EMBODIMENTS ACCORDING TO FIGS. 5 THROUGH 7

These bearing ring embodiments, which are also described below in detail, can be used to particular advantage within the scope of the present invention. Essentially, however, these are bearing ring embodiments that be used anywhere, independently of an adjustable camshaft according to the present invention in such cases in which liquid is to be passed through the bearing ring from ring channels on the outside circumference of the bearing ring, namely in the case of ring channels arranged axially side-by-side and the shortest possible axial design of the bearing ring.

BEARING RING EMBODIMENT ACCORDING TO FIG. 5

A bearing ring 30 has ring channels 31 running in axial proximity on its outside circumference, corresponding functionally to the ring channels 9", 10", 11" and 12" in the embodiment of the bearing ring 3 according to FIG. 1. Radial bores 31 lead from the ring channels 31 into the internal circumferential area of the bearing ring 30. Individual ring channels 31 have sealing rings 33, one of which is in contact with each of the two axial sides of these ring channels 31. For secure contact of the sealing rings 33 with the contact sides of the ring channels 31, the ring channels 31 ensure this via anchors 34 distributed around the circumference in the form of pins protruding radially out of the base of the groove as axial abutments for the sealing rings 33.

The sealing rings 33 ensure a mutually tight bordering of the ring channels 31 in the case of a bearing of the bearing ring 30 in an abutment in an embodiment according to that of the abutment 4 in FIG. 1. Due to the arrangement of the sealing rings 33 described above, in the case of multiple ring channels 31 arranged axially side-by-side, a short axial length of the bearing ring 30 can thus be achieved in this way. This is made possible by the fact that the sealing rings 33 according to this invention need not each be accommodated in their own ring web. In the case of two ring channels 31 arranged axially side-by-side, each designed with sealing rings 33 in the manner described above, another ring channel 31 which, separately from the others, is not lined with sealing rings 33, may be situated axially between these ring channels 31. The adjacent sealing rings 33 here assume the function of axial bordering walls for the ring channel 31 that is free of sealing rings.

BEARING RING EMBODIMENT ACCORDING TO FIG. 6

This bearing ring design has in principle an alternative that corresponds to that according to FIG. 5 with regard to the ring channel design. This alternative consists exclusively of the fact that for stabilization of the position of the sealing rings 33 on the adjacent groove sides of the ring channels 31, no anchors 34 are provided, fastened at the base of these ring channels 31. Instead the position is secured here by restraining means which are integrated into the sealing rings 33 themselves. These restraining means may consist of a wide variety of types and must serve essentially only to secure the positions of the sealing rings 33 on the side flanks of the ring channels 31 without excessively preventing a flow of liquid through the respective ring channels 31.

The exploded diagram in figure section b illustrates two sealing rings 33 which are combined in a so-called tandem ring. This combination is provided by the fact that two sealing rings 33 which are slotted on their circumference are joined together by a bridge element 35 on one of their butt ends, a web 36 having an H-shaped cross section extending from the bridge member for bridging the butt gap into the axial interspace of the ends of the sealing rings 33 that form the second end of the but gap.

It is of course also possible that in the case of such a tandem ring, spacers may be provided between the sealing ring partners of the tandem ring that are to be kept with a distance between them and are distributed over the entire circumference. The spacers, each of which is to be fixedly connected to at least one of the two partner sealing rings, are merely to be mounted in such a way that they do not have a negative effect on the tension properties of the sealing ring 33 on the one hand while on the other hand not interfering with the distribution of liquid within the ring channel 31 to which they are allocated.

BEARING RING EMBODIMENT ACCORDING TO FIG. 7

The bearing ring according to this embodiment has an outside circumference with a uniform diameter. The radial bores 32 of the bearing ring 30 open into this outside wall.

The ring channels 31 in this embodiment are formed by sealing rings 33, which are inserted axially between a radial bore 32 in a form-fitting manner enclosed in receiving grooves in the outside wall area of the bearing ring 30. These sealing rings 33 are each supported in continuous bearing ring material over practically the entire circumference of the bearing ring 30 and are in direct or indirect contact with the radial bores only in the area of the radial bores 32, so a short axial design of the respective bearing ring 30 can also be achieved here.

The bearing rings may be made of metal or plastic and slotted on the circumference, stretching outward in the manner of piston rings.

However, it is also possible to use closed sealing rings made of an elastically stretchable material. These may then have an approximately H-shaped cross section. In this design, the elevated legs serve as sealing rings 33 of a sealing ring tandem and the middle web serves as a spacer. The middle web must of course be provided with flow-through openings.

In general the following statement also applies to the present invention including all the embodiments described above.

All the features depicted in the description and in the following claims may be essential to the invention when considered individually as well as combined with one another in any form.

The invention claimed is:

1. An adjustable camshaft, for an internal combustion engine for a motor vehicle, wherein two shafts, namely one inner shaft and one outer shaft (2, 1), each fixedly connected to the cams, are rotatable in relation to one another, to create a relative movement, a hydraulic adjusting device (5) is provided at one of its ends, in the adjusting device (5) oppositely rotatable adjusting elements (6, 7) are each fixedly connected to one of the two shafts (1, 2), and the outer shaft (1) is adjacent to the adjusting device (5), with a bearing ring (3) supporting the shafts (1, 2) in a stationary abutment (4), and is fixedly connected to the bearing ring, comprising the features at least one of the adjusting elements (6, 7) of the adjusting device (5) fixedly connected to the two shafts (1, 2) is at least partially in tight contact at the end with a connecting face (8) which is formed by the bearing ring (3) of the outer shaft (1) with respect to the two shafts (1, 2) including the bearing ring (3), the connecting face (8) has passages running axially through it between the hydraulic chambers of the adjusting device (5) and the hydraulic fluid feed channels (9, 10, 11, 12), the feed channels (9, 10, 11, 12) lead through the shafts and/or between the shafts (1, 2) and/or through ring gaps ($10^{IV}$, $11^{IV}$) formed between the outer shaft (1) and the bearing ring (3) from the connecting face (8) to the filling areas in the circumferential surface of the bearing ring (3), the filling areas open into peripheral ring channels (9", 10", 11", 12") each allocated to the filling areas of a feed channel (9, 10, 11, 12).

2. The adjustable camshaft according to claim 1, wherein the bearing ring (3) has an outer ring (3") that is fixedly attached to an inside area (3') of the bearing ring (3), whereby the feed channels (409) within the connecting face are adjacent to the two ring areas (3', 3"), i.e., to both the inside area (3') and the outside ring (3").

3. The bearing ring, of an adjustable camshaft according to claim 1, comprising at least individual circumferential ring channels (31) that are formed on the bearing ring side by ring grooves engaging in the outside circumference of the bearing ring (30) as well as sealing rings (33) which are each in contact with the ring groove sides and protrude radially beyond the outside circumference of the bearing ring, secured in position via spacers (36) that are unbound with respect to the bearing ring (30) or by means of anchors (34) secured at the base of the ring channels (31).

4. The bearing ring, of an adjustable camshaft according to claim 1, comprising at least individual ring channels (31) which are formed on the bearing ring end by sealing rings (33) that have the same diameter and engage only in the outside circumference of the bearing ring (30) and protrude radially on the outside beyond the bearing ring outside circumference having the same diameter.

* * * * *